US006984940B2

(12) United States Patent
Nugues et al.

(10) Patent No.: US 6,984,940 B2
(45) Date of Patent: Jan. 10, 2006

(54) ELECTRONIC TUBE WITH SIMPLIFIED COLLECTOR

(75) Inventors: Pierre Nugues, Symphorien le Ch. Auneau (FR); Jean-Paul Nesa, Paris (FR)

(73) Assignee: Thales, Neuilly sur Seine (FR)

( * ) Notice: Subject to any disclaimer, the term of this patent is extended or adjusted under 35 U.S.C. 154(b) by 0 days.

(21) Appl. No.: 10/498,792

(22) PCT Filed: Dec. 10, 2002

(86) PCT No.: PCT/FR02/04265

§ 371 (c)(1),
(2), (4) Date: Jun. 14, 2004

(87) PCT Pub. No.: WO03/054899

PCT Pub. Date: Jul. 3, 2003

(65) Prior Publication Data

US 2005/0067965 A1 Mar. 31, 2005

(30) Foreign Application Priority Data

Dec. 14, 2001 (FR) ..... 01 16242

(51) Int. Cl.
*H01J 23/02* (2006.01)

(52) U.S. Cl. ..... 315/5.38; 315/5.35; 315/5; 330/42; 330/46

(58) Field of Classification Search ..... 315/5.38, 315/5.35, 5, 3, 3.5, 39.3, 39.51, 39.53; 330/42, 330/46, 43, 47, 41
See application file for complete search history.

(56) References Cited

U.S. PATENT DOCUMENTS

| | | | | |
|---|---|---|---|---|
| 4,096,409 | A | 6/1978 | Hechtel | |
| 4,398,122 | A | 8/1983 | Gosset | |
| 6,617,791 | B2 * | 9/2003 | Symons | 315/5.38 |
| 2001/0011924 | A1 | 8/2001 | Symons | |

FOREIGN PATENT DOCUMENTS

| | | | |
|---|---|---|---|
| GB | 919 767 | A | 2/1963 |
| JP | 09 293455 | A | 2/1998 |
| WO | 01 57906 | A | 8/2001 |

* cited by examiner

*Primary Examiner*—Tuyet Thi Vo
(74) *Attorney, Agent, or Firm*—Lowe Hauptman & Berner LLP.

(57) ABSTRACT

The invention relates to amplifying electron tubes operating at microwave frequencies. The electron tube comprises: a pump-out tube that allows the vacuum inside the electron tube to be created; an electron gun that emits an electron beam inside the electron tube; a collector that directly collects a first portion of the electron beam. The pump-out tube directly repels a second portion of the electron beam in the direction of the collector.

6 Claims, 4 Drawing Sheets

ELECTRONIC TUBE WITH SIMPLIFIED COLLECTOR

BACKGROUND OF THE INVENTION

The invention relates to amplifying electrode tubes operating at microwave frequencies. It applies more particularly to TWTs (travelling wave tubes), and it is therefore with regard to such a tube that the invention will be described. Such tubes are used, for example, for the transmission of telecommunication signals between Earth and satellites. They are also used as power transmitters in radars.

It will be briefly recalled that a TWT is a vacuum tube using the principle of interaction between an electron beam and a microwave electromagnetic wave in order to transfer part of the energy contained in the electron beam to the microwave so as to obtain, as output from the tube, a microwave of higher energy than that of the wave injected into the input of the tube.

FIG. 1 recalls the general principle of a TWT. The TWT shown is a helix TWT, but other types of TWT, such as TWTs with coupled cavities, TWTs with folded waveguides in the form of meanders, etc., are just as well covered by the invention.

TWTs comprise an elongate tubular sheath 10, in which a vacuum is created, with, at a first end, an electron gun 11 that emits an electron beam 12 and, at a second end, a collector 14; the collector collects the electrons that have given up some of their initial energy to the electromagnetic wave that it is desired to amplify. The electron beam 12 is substantially cylindrical over almost the entire length of the tube between the gun 11 and the collector 14 along an axis 15. This cylindrical beam shape is obtained, on the one hand, by the shape of a cathode 16 of the electron gun 11 (a cup-shaped convergent cathode) and, on the other hand, by magnetic focussing means provided over the entire length of the sheath 10 between the exit of the electron gun 11 and the entrance of the collector 14. In the electron gun 11, it is the cathode 16 that emits the electron beam 12. These focussing means comprise, for example, annular permanent magnets 18 that are axially magnetized and of magnetization that alternates from one magnet to the next; these magnets surround the sheath 10 and are separated from one another by pole pieces 20 of high magnetic permeability.

In the case of a helix TWT, the electron beam 12 passes into a helical conducting structure 22 along which the microwave electromagnetic wave to be amplified flows; the amplification of microwave energy takes place by interaction between this microwave and the electron beam 12 that passes through the centre of the helix. The latter serves to decelerate the microwave in such a way that its velocity, along the axis 15 of the electron beam 12, is approximately equal to that of the electron beam 12.

A signal to be amplified of power Pe is injected at one end of the helical conducting structure 22 through a plug and a port 24 inside the sheath 10. An amplified signal of power Ps is extracted at the other end of the helical conducting structure 22 through a plug and a port 26. The amplification gain G of the electron tube is defined by the ratio G=Ps/Pe or, expressed in decibels, 10 $\log_{10}$(Ps/Pe). The efficiency η of the amplification is defined by:

$$\eta = Ps/V_o x I_o.$$

$V_o$ represents the voltage between the cathode 16 and the collector 14 and $I_o$ represents the current flowing in the cathode 16. The efficiency η is generally around 20 to 30%.

It is often called the interaction efficiency ηi and it characterizes that part of the energy of the electron beam 12 converted into microwave energy in the amplified signal. The remaining energy, $(1-\eta i)\ V_o x I_o$, in the electron beam 12 after the latter has passed through the helical conducting structure 22, is then dissipated in the collector 14 where the electrons of the beam 12 bombard the walls of the collector 14 and convert their kinetic energy into heat. This heat is then discharged to the outside of the electron tube by conduction, convection or radiation. On the outside of the elongate tubular sheath 10, the electron tube usually has, near the collector 14, a heat sink (not shown in FIG. 1). This heat sink is, for example, cooled by circulation of a liquid or gaseous fluid.

In practice, one portion of the current $I_o$, coming from the cathode 16, flows in the helical conducting structure 22 as shown in FIG. 2.

In this figure, the collector 14 is connected to the positive pole 28 of a DC voltage source 30. The helical conducting structure is also connected to the positive pole 28. The negative pole 32 of the DC voltage source 30 is connected to the cathode 16. The electron beam 12 develops between the cathode 16 and the collector 14. In an experimental arrangement, using a 10 kV DC voltage source 30, a current of 1 A output by the cathode 16 is obtained in the electron beam 12 and a power Ps of 2 kW is obtained as output from the helical conducting structure 22. The return current between the collector 14 and the pole 28 is 0.99 A and the current between the helical conducting structure 22 and the pole 28 is 0.01 A. The efficiency is then expressed as:

$$\eta \frac{2\ \text{kW}}{10\ \text{kV} \times (0.99 + 0.01)} = 20\ \%.$$

The efficiency of an electron tube may be improved by using two voltage sources. This alternative arrangement is shown in FIG. 3. A first DC voltage source 34, for example of 10 kV, is connected between the cathode 16 and the helical conducting structure 22 and a second DC voltage source 36, the voltage of which is lower than that of the first voltage source, for example 6 kV, is connected between the collector 14 and the cathode 16. Assuming the same current and power values as in the example given above in FIG. 2, the efficiency is then expressed as:

$$\eta = \frac{2\ \text{kW}}{(10\ \text{kV} \times 0.01) + (6\ \text{kV} \times 0.99)} = 33\%.$$

Advantageously, the collector 14 comprises several electrodes raised to various potentials. These various electrodes have the purpose of decelerating the electrons before they strike the walls of the electrodes. Thus, the heat dissipated in the collector 14 is less and the efficiency η increases.

An example of such a collector is shown in FIG. 4. In this example, the 10 kV DC voltage source 34 is connected between the helical conducting structure 22 and the cathode 16. A current of 0.1 A flows in the voltage source 34.

A DC voltage source 38, for example of 6 kV, is connected between a first electrode 40 and the cathode 16. A current of 0.4 A flows in the voltage source 38. A DC voltage source 42, for example of 4 kV, is connected between a second electrode 44 and the cathode 16. A current of 0.48 A flows in the voltage source 42. A second voltage source 46, for example of 1 kV, is connected between a third electrode 48 and the cathode 16. A current of 0.01 A flows in the voltage source 46. The three electrodes 40, 44 and 48, which belong to the collector 14, are placed in such a way that the electrode 40, subjected to the highest voltage relative to the cathode 16, is the closest to the cathode 16 and the electrode 48, subjected to the lowest voltage relative to the cathode 16, is furthest away from the cathode 16. Again assuming the power Ps is 2 kW, the efficiency is expressed in the following manner:

$$\eta = \frac{2\ \text{kW}}{(10\ \text{kV} \times 0.01) + (6\ \text{kV} \times 0.40) + (4\ \text{kV} \times 0.48) + (1\ \text{kV} \times 0.01)} = 45\%.$$

DETAILED DESCRIPTION OF THE PREFERRED EMBODIMENT

This structure of the collector 14, comprising several electrodes, is called a depressed collector. Of course, the number of electrodes and the numerical values of the currents, voltages and powers, have been given merely by way of example and the invention is not limited to these examples.

Although the final electrode has a low potential difference relative to the cathode 16, the kinetic energy of the electrons that bombard it is still high and generates heat that has to be removed. The position on the end of the electron tube of the electrode 48 increases the difficulties in removing the heat that the electron bombardment generates since this position on the end of the tube is generally used to place means for creating the vacuum inside the electron tube, which vacuum is needed for establishing the electron beam 12. To remove the heat generated within the electrode 48, it is necessary to ensure heat transfer to the cooling means located in the immediately vicinity of the electrodes 40 and 44 on the side walls of the electron tube. This heat transfer is again difficult to achieve, especially because of the differential thermal expansion between electrically conducting elements, such as the electrodes 40, 44 and 48, and insulating elements that separate these electrodes. It will be possible to reduce the heat generated within the electrode 48 by reducing the potential difference of the DC voltage source 46. However, with this solution there will be a risk of reflecting a portion of the electron beam 12 bombarding the electrode 48 in the direction of the cathode 16. This reflection runs the risk of destroying the helical conducting structure 22.

SUMMARY OF THE INVENTION

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive. The present invention is illustrated by way of example, and not by limitation, in the figures of the accompanying drawings, wherein elements having the same reference numeral designations represent like elements throughout and wherein:

The object of the invention is to alleviate this problem, by direct use of the means for creating the vacuum in the electron tube to repel a portion of the electron beam 12 towards the other electrodes 40 and 44 and not in the main direction of the beam indicated by the axis 15 in FIG. 1.

For this purpose, the subject of the invention is an electron tube comprising:

- a pump-out tube that allows the vacuum inside the electron tube to be created;
- an electron gun that emits an electron beam inside the electron tube;
- a collector that directly collects a first portion of the electron beam;

characterized in that the pump-out tube directly repels a second portion of the electron beam in the direction of the collector.

In a preferred embodiment of the invention, the pump-out tube opens, inside the electron tube, along the axis of the electron beam. This simplifies the construction of the end of the tube.

The invention will be more clearly understood and other advantages will appear on reading the detailed description of one embodiment given by way of example, which embodiment is illustrated by the appended drawing in which:

BRIEF DESCRIPTION OF THE DRAWINGS

The present invention is illustrated by way of example, and not by limitation, in the figures of the accompanying drawings, wherein elements having the same reference numeral designations represent like elements throughout and wherein:

To simplify the rest of the description, the same elements will bear the same reference numbers in the various figures.

FIGS. 1 to 4 have already been described above in order to introduce the invention.

FIG. 5 shows, in part, an illustrative example of an electron tube for implementing the invention. This electron tube comprises the tubular sheath 10 inside which the vacuum is created by means of a pump-out tube 50, the open end 52 of which penetrates the inside of the sheath 10. The other end of the pump-out tube is not shown in FIG. 5 and is connected to a vacuum pump during the electron tube manufacturing operations. When a sufficient vacuum has been created inside the electron tube, the pump-out tube 50 is tipped off, for example by pinching it until the walls of the pump-out tube are cold-welded together to form a hermetic seal.

Figure 1:
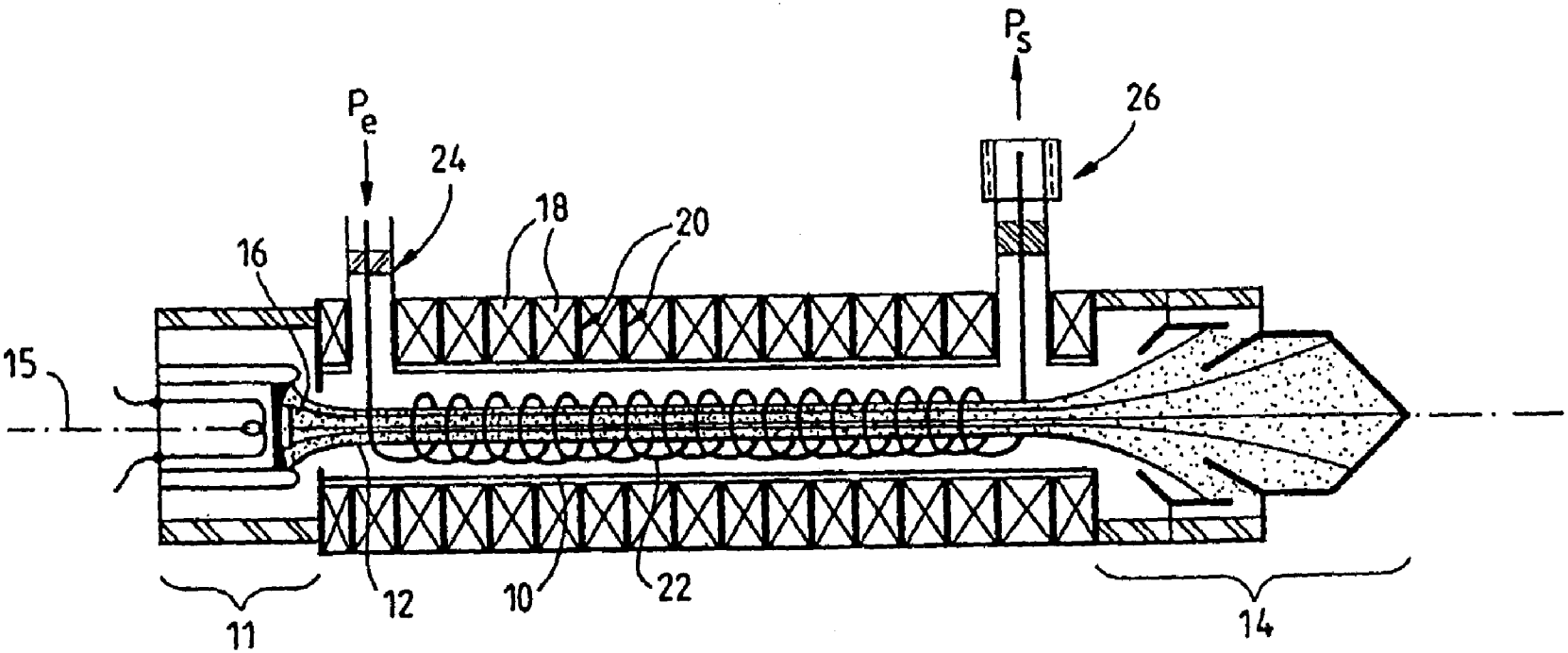
FIG. 1 shows schematically the general operation of an electron tube.
Figure 2:
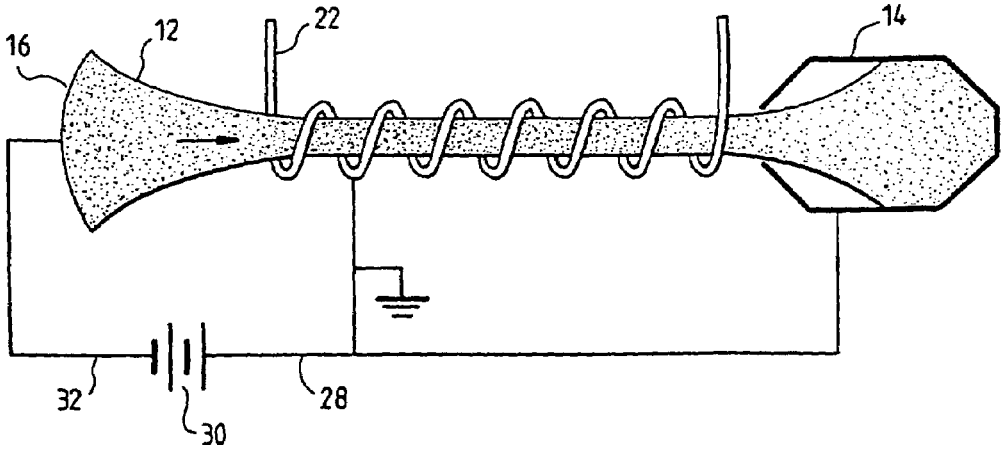
FIG. 2 shows an electron tube using a single DC voltage source.
Figure 3:
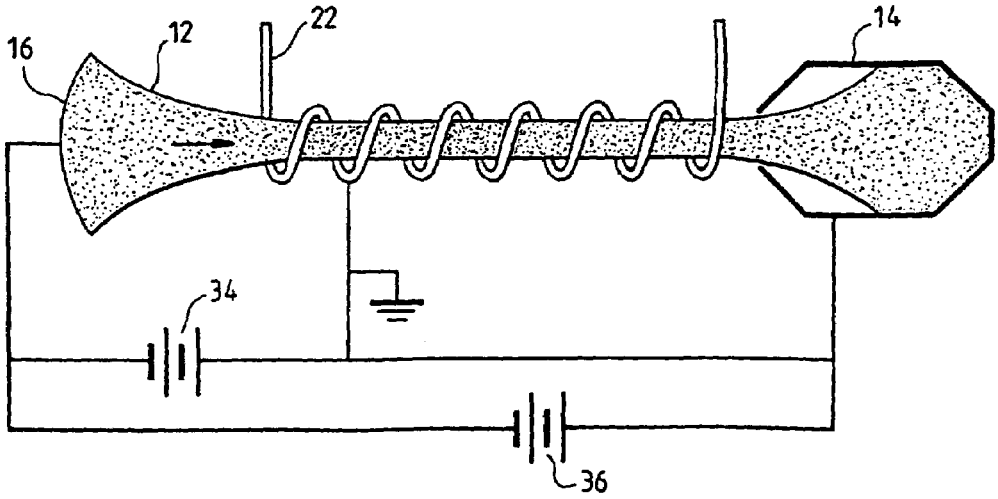
FIG. 3 shows an electron tube using two DC voltage sources.
Figure 4:
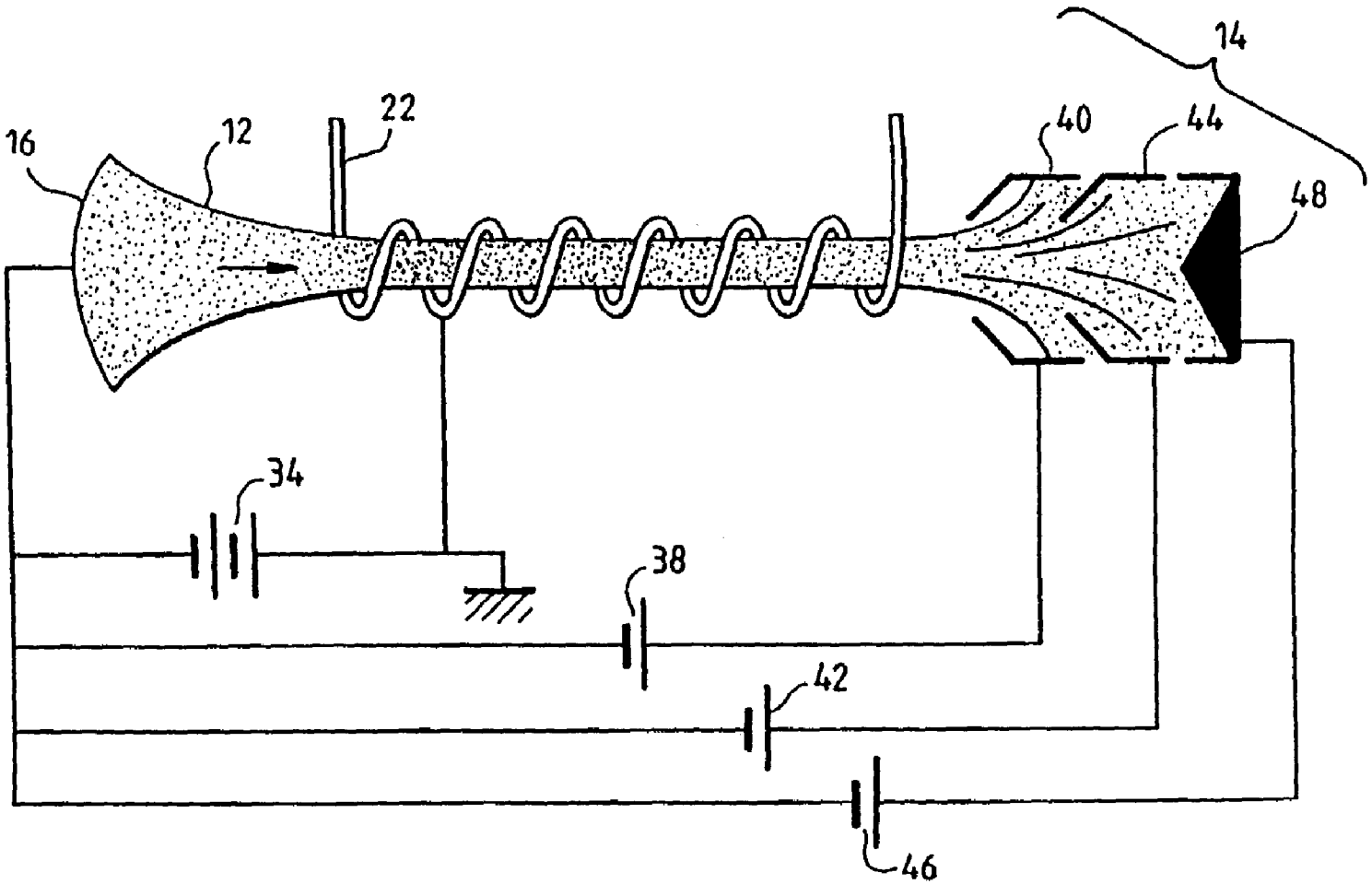
FIG. 4 shows an electron tube having four DC voltage sources and one depressed collector.
Figure 5:
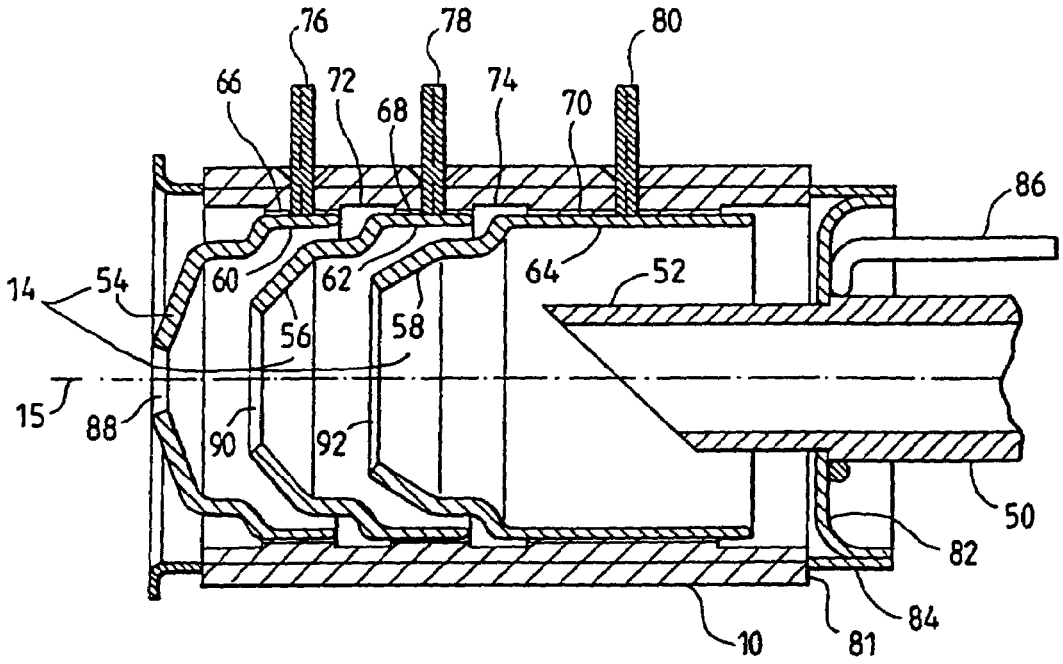
FIG. 5 shows one end of the electron tube with a depressed collector and part of means for creating the vacuum inside the electron tube.

The electron tube includes an electron gun 11 (not shown in the figure), which emits the electron beam 12 inside the electron tube, and a collector 14 that directly collects a first portion of the electron beam 12. The collector 14 has at least one electrode. It has three electrodes 54, 56 and 58 in the example shown. The three electrodes 54, 56 and 58 are axisymmetric about the axis 15 along which the electron beam 12 mainly runs. Each electrode 54, 56 and 58 has a cylindrical part, respectively 60, 62 and 64, fastened to the inside of the cylindrical sheath 10. The sheath 10 is also used about the axis 15. The sheath 10 is, for example, made of ceramic and includes metallized parts 66, 68 and 70 that receive the respective electrodes 54, 56 and 58.

The electrodes are, for example, based on copper and their cylindrical parts 60, 62 and 64 are brazed to the respective metallized parts 66, 68 and 70 of the sheath 10. Between these metallized parts, the sheath 10 has grooves 72 and 74 which provide the insulation between the three electrodes 54, 56 and 58. Each of all three of the electrodes 54, 56 and 58 is connected to a voltage source via respective connection means 76, 78 and 80.

The three electrodes are pierced along the axis 15 with orifices, respectively 88, 90 and 92 that let the electron beam 12 pass, at least partly.

One end 81 of the sheath 10 is closed off by a cover 82 that is mechanically connected to the sheath 10 with sufficient elasticity to withstand any thermal stresses. This resilient connection between the sheath 10 and the cover 82 is, for example, achieved by means of a collar 84. The cover 82 is axisymmetric about the axis 15. Its centre is pierced so that the pump-out tube 50 penetrates inside the electron tube. The pump-out tube is electrically connected to a voltage source (not shown in the figure) via connection means 86. The voltage thus delivered to the pump-out tube 52 is close to that of the cathode 16 forming part of the electron gun 11.

When a portion of the electron beam 12 is not collected by one of the three electrodes 54, 56 or 58, the pump-out tube 50 repels, directly, without an intermediary, this portion of the electron beam 12 in the direction of the collector 14 and more particularly to the electrode 58.

Advantageously, the pump-out tube 50 has the shape of a nozzle, the end 52 of which, located inside the electron tube, is open. The pump-out tube 50 in fact repels that portion of electron beam 12 arriving in its vicinity. It may remain open in the direction of the axis 15 as no electron (or very few electrons) can penetrate into the pump-out tube 50. There is therefore no risk of the temperature of the pump-out tube 50 rising owing to electron bombardment.

Advantageously, the end 52 of the pump-out tube 50 has a shape that is asymmetrical with respect to the axis 15. This shape is, for example, obtained by bevelling the end 52. The bevel thus formed is a cut made at the end 52 in a plane not perpendicular to the axis 15. This asymmetrical shape allows the electrons arriving on the pump-out tube 50 along the axis 15 to be repelled along an axis other than the axis 15 and thus to reach one of the electrodes, especially the electrode 58. The bevelled cut of the end 52 is very simple to produce, for example by cutting off the pump-out tube 50 at an angle.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. An electron tube, comprising:

a pump-out tube that allows the vacuum inside the electron tube to be created;

an electron gun that emits an electron beam inside the electron tube;

a collector that directly collects a first portion of the electron beam;

wherein the pump-out tube directly repels a second portion of the electron beam in the direction of the collector and in that the pump-out tube is formed by a nozzle having one end, lying inside the electron tube, that is opened in a main direction of the electron beam.

2. The electron tube as claimed in claim 1, wherein the electron gun has a cathode that emits the electrons, wherein the pump-out tube is connected to a voltage source and in that the voltage source delivers a voltage to the pump-out tube that is close to the voltage of the cathode.

3. The electron tube as claimed in claim 1, wherein said end of the pump-out tube has a shape that is asymmetrical with respect to the main direction of the electron beam.

4. The electron tube as claimed in claim 3, wherein said end of the pump-out tube is bevelled.

5. The electron tube as claimed in claim 3, wherein the electron gun has a cathode that emits the electrons, wherein the pump-out tube is connected to a voltage source and in that the voltage source delivers a voltage to the pump-out tube that is close to the voltage of the cathode.

6. The electron tube as claimed in claim 4 wherein the electron gun has a cathode that emits the electrons, wherein the pump-out tube is connected to a voltage source and in that the voltage source delivers a voltage to the pump-out tube that is close to the voltage of the cathode.

* * * * *